US009718085B2

(12) United States Patent
McGuffey

(10) Patent No.: US 9,718,085 B2
(45) Date of Patent: Aug. 1, 2017

(54) HOT MELT ADHESIVE APPLICATOR SYSTEM WITH SMALL FOOTPRINT

(71) Applicant: Illinois Tool Works Inc., Glenview, IL (US)

(72) Inventor: Grant McGuffey, Springfield, TN (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 15/097,045

(22) Filed: Apr. 12, 2016

(65) Prior Publication Data

US 2016/0303597 A1 Oct. 20, 2016

Related U.S. Application Data

(60) Provisional application No. 62/150,080, filed on Apr. 20, 2015.

(51) Int. Cl.
*B05B 9/04* (2006.01)
*B05C 5/02* (2006.01)

(52) U.S. Cl.
CPC ..... *B05C 5/0279* (2013.01)

(58) Field of Classification Search
None
See application file for complete search history.

(56) References Cited

U.S. PATENT DOCUMENTS 5,862,986 A * 1/1999 Bolyard, Jr. ..... B05B 7/164 137/115.13
6,089,413 A * 7/2000 Riney ..... B05B 7/0861 222/318
6,688,498 B1 2/2004 McGuffey
7,908,997 B2 3/2011 Lessley et al.
8,413,848 B2 4/2013 McGuffey
2008/0245298 A1* 10/2008 Ayers ..... B05C 5/0254 118/313
2011/0052811 A1* 3/2011 McGuffey ..... B05C 5/025 427/256
2012/0187145 A1 7/2012 Gould et al.

OTHER PUBLICATIONS

International Search Report issued by the ISA/EP in connection with PCT/US2016/027326 on Jun. 27, 2016.

* cited by examiner

*Primary Examiner* — Dah-Wei D Yuan
*Assistant Examiner* — Jethro M Pence
(74) *Attorney, Agent, or Firm* — Levenfeld Pearlstein, LLC

(57) ABSTRACT

A dispensing system for dispensing fluid onto a substrate includes a manifold having internal passageways for fluid flow and one or more driving gears, a drive arm mounted on the manifold, the drive arm movable between first and second positions, and having a drive motor configured to drive the one or more drive gears. The system further includes one or more pump assemblies mounted on a top surface of the manifold, each pump assembly formed as a rotary gear pump having a gear train including two gears. One of the gears is disposed in meshed relationship with a respective drive gear of the one or more drive gears. The system also includes a filter block for filtering the fluid, one or more nozzles for dispensing the fluid onto the substrate, an applicator or nozzle adapter, and one or more valve assemblies for controlling flow of the fluid to the one or more nozzles.

14 Claims, 8 Drawing Sheets

HOT MELT ADHESIVE APPLICATOR SYSTEM WITH SMALL FOOTPRINT

BACKGROUND

The following description relates to a fluid dispensing system, for example, a hot melt adhesive applicator, for applying a hot melt adhesive to an underlying substrate, and in particular, a hot melt adhesive applicator having a reduced footprint to allow for use in applications where machine space in limited and/or smaller products are desired.

Hot melt adhesive or other thermoplastic material dispensing systems can dispense two or more different hot melt adhesives or other thermoplastic materials. The hot melt adhesive materials may be dispensed in, for example, two or more different types of patterns, two or more different types of application techniques or processes, or two or more different types of cyclical operations.

These material dispensing systems may be used in different applications for manufacturing different products or articles. For example, these dispensing systems may dispense the hot melt adhesive or other thermoplastic material onto a substrate in the manufacture of products, such as, but not limited to, hygiene apparel and personal hygiene products, home furnishings, health care products, engineering products, industrial products, packaging and consumer goods.

The material dispensing systems typically include one or more nozzles configured to discharge the material onto the substrate, such as a non-woven fabric. In some configurations, the nozzle may discharge the material onto an elasticated strand or strands for subsequent bonding to a substrate. Still, in other configurations, the nozzles may discharge the material onto a product component, such as an absorbent pad, a layer of material, a fastener and/or band, for example, for subsequent bonding to a substrate or other component of the product.

One such system for dispensing a hot melt adhesive or other thermoplastic material is described in U.S. Pat. No. 7,908,997, to Lessley et al., and commonly assigned with the instant application. Referring to FIG. 1, the system 100 of U.S. Pat. No. 7,908,997 includes, generally, a drive motor 108, a gear box 110, an electrical junction box 114, a drive gear manifold 104, a rear-mounted metering pump assembly 106 on the drive gear manifold 104, a metering station 102, a filter block 120, a metering head 103 and application modules 138. The metering pump assembly 106 is includes a three-gear drive such as that shown and described in U.S. Pat. No. 6,688,498 to McGuffey, commonly assigned with the instant application.

However, the system of U.S. Pat. No. 7,908,997 may have a large footprint such that in the production of smaller products or articles, for example, feminine care products, a significant amount of space occupied by the system is going unused. That is, existing hot melt adhesive or other thermoplastic dispensing systems may be oversized for particular applications or product lines, resulting in unused or underutilized factory space during the production of the smaller products. In addition, the system of U.S. Pat. No. 7,908,997 may be difficult to install in facilities having limited space available.

The footprint or size of known systems may be attributed to one or more factors. For example, some known systems include a drive gear manifold holding a shaft and drive gears for driving the pumps of a pump assembly mounted thereto, and a service block or main manifold that includes, inter alia, heating elements, wiring cavities for necessary electrical connections, and fluid conduits for the hot melt adhesive material. That is, some existing systems are manufactured having two manifolds secured to one another. A nozzle adapter may also be included, typically secured to the main manifold. Further, to maintain the hot melt adhesive or other thermoplastic material at desired temperatures, additional heater elements may be provided, for example, in the filter block. Thus, the filter block must also be provided having sufficient size to accommodate heater elements.

Accordingly, it is desirable to provide a hot melt adhesive or other thermoplastic dispensing system having fewer parts and a small footprint to efficiently utilize available space in manufacturing facilities and/or in the production of small products, such as feminine care products.

SUMMARY

According to one aspect, there is provided a dispensing system for dispensing and depositing one or more fluid depositions onto at least one region of a substrate moving along a longitudinally extending flow path with respect to the dispensing system. The system includes a manifold having internal passageways for fluid flow therein and one or more drive gears, and a drive arm mounted on the manifold, the drive arm movable between a first position and a second position, the drive arm having a drive motor configured to drive the one or more driving gears. The system further includes one or more pump assemblies mounted on a top surface of the manifold, each pump assembly formed as a rotary gear pump having a gear train having two gears, wherein one of the gears is disposed in meshed relationship with a respective drive gear of the one or more drive gears, a filter block for filtering the fluid received in the system, an applicator or nozzle adapter fluidically connected to the manifold, one or more applicators or nozzles fluidically connected to the applicator or nozzle adapter and configured to dispense the fluid onto the substrate and one or more valve module assemblies configured to control flow of the fluid to the one or more nozzles.

Other objects, features, and advantages of the disclosure will be apparent from the following description, taken in conjunction with the accompanying sheets of drawings, wherein like numerals refer to like parts, elements, components, steps, and processes.

BRIEF DESCRIPTION OF THE DRAWINGS

Various other features and attendant advantages of the present device, system and method will be more fully appreciated from the following detailed description when considered in connection with the accompanying drawings in which like reference characters designate like or corresponding parts throughout the several views, and wherein.

DETAILED DESCRIPTION

Figure 1:
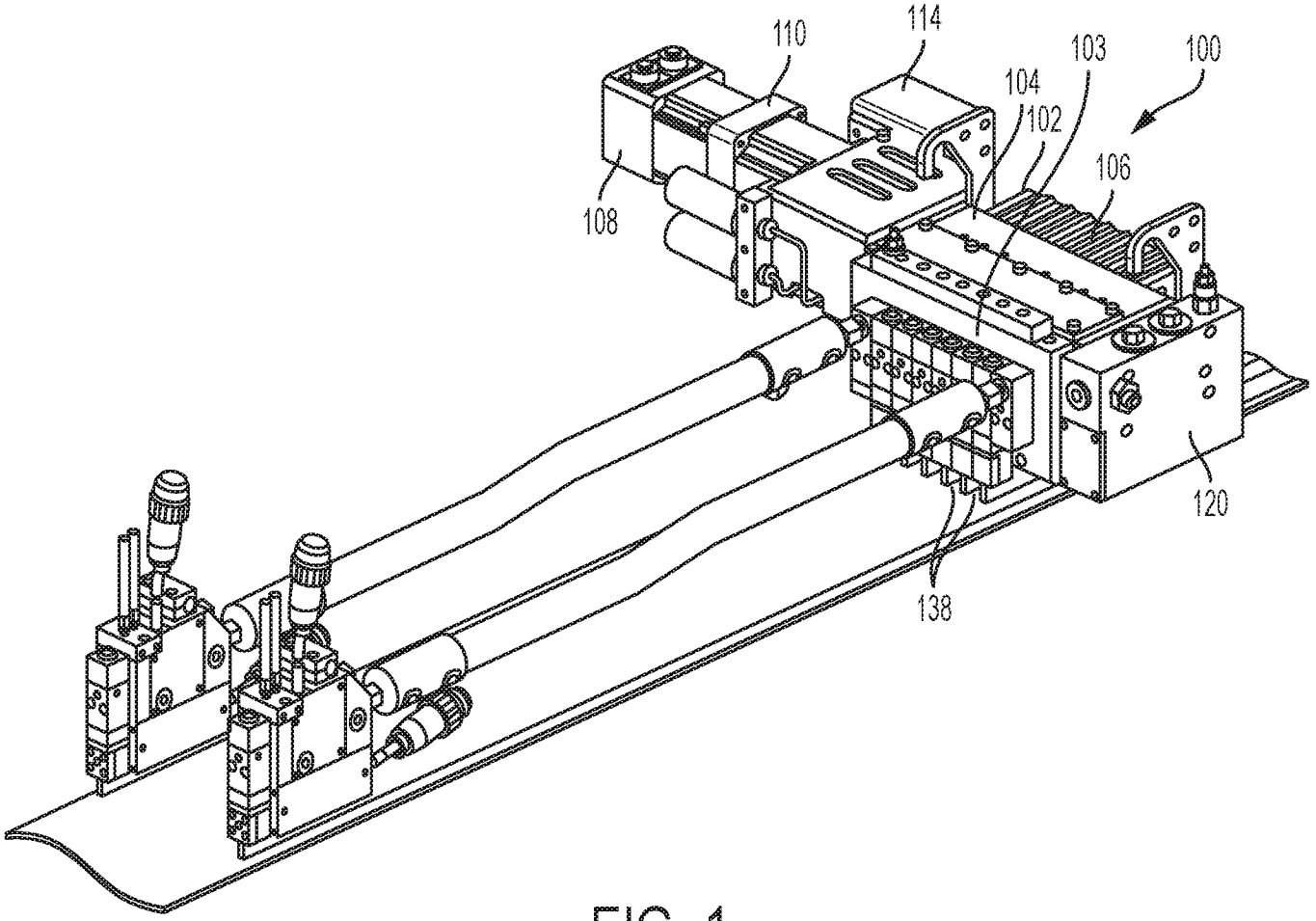
FIG. 1 is a perspective view of a conventional hot melt adhesive or thermoplastic material dispensing system.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

Figure 2:
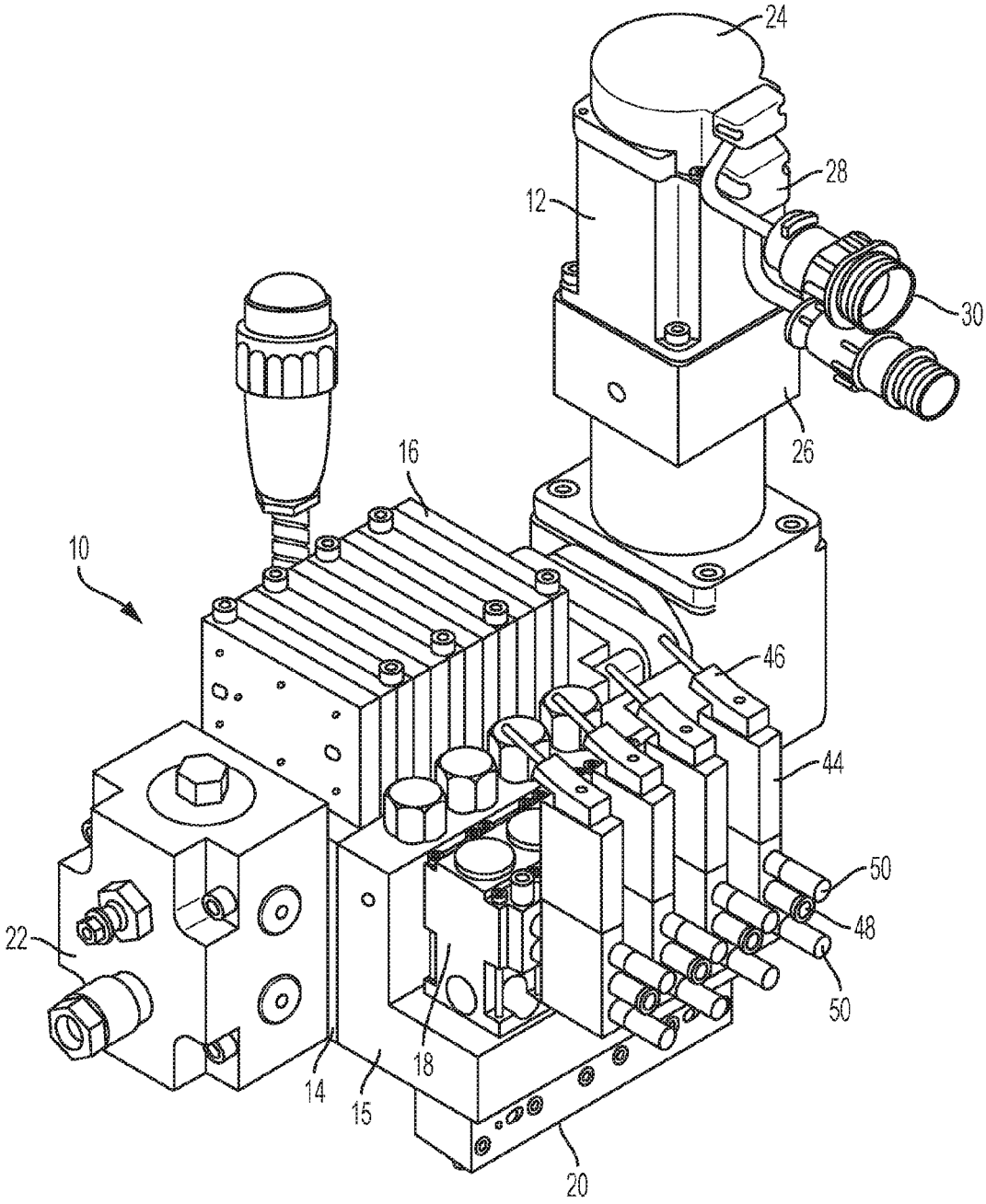
FIG. 2 is a perspective view of a hot melt adhesive or thermoplastic material dispensing system according to an embodiment described herein.
Figure 3:
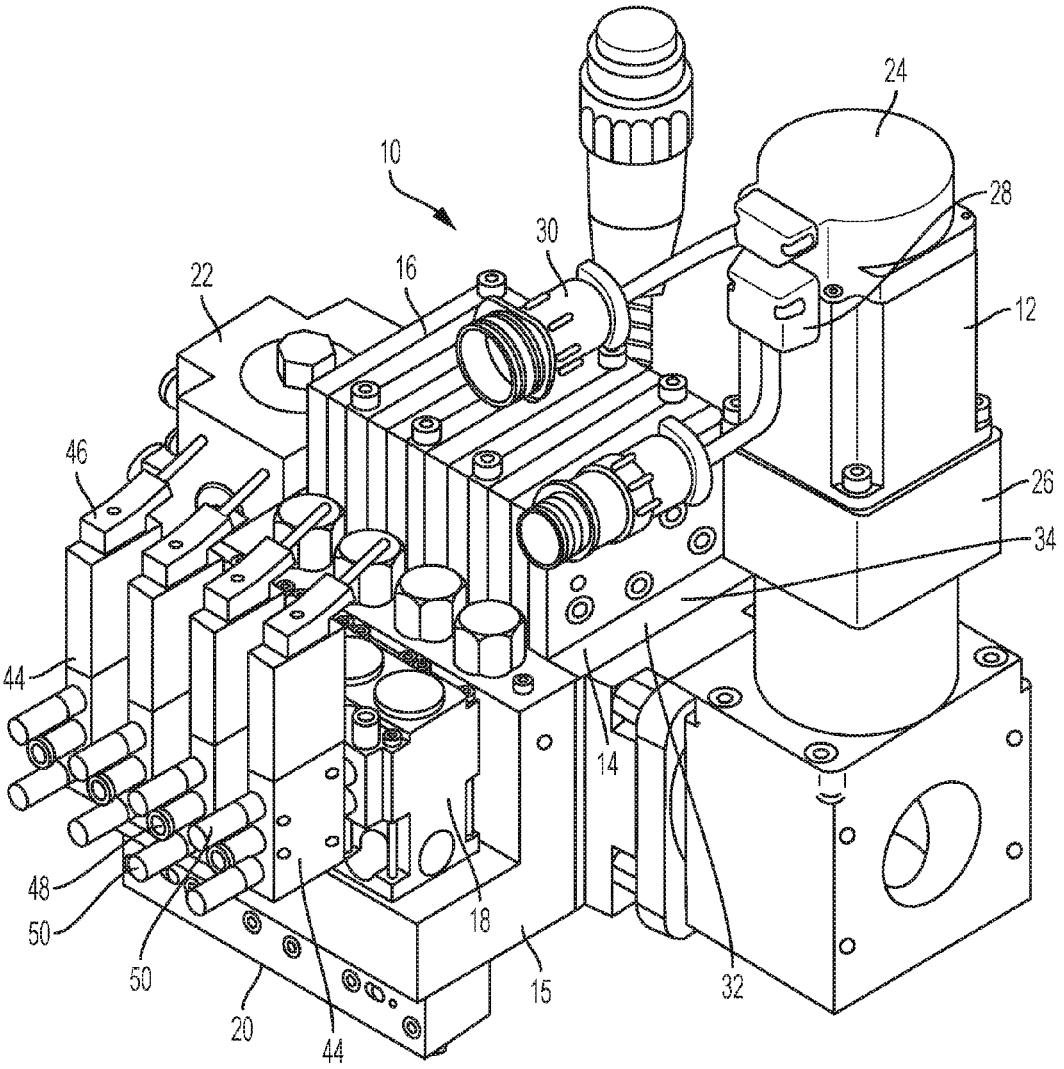
FIG. 3 is another perspective view of the material dispensing system of FIG. 2.

FIGS. 2 and 3 are perspective views of a fluid dispensing system 10 having a small footprint according to the embodiments described herein. In one embodiment, the fluid may be a hot melt adhesive or other thermoplastic material, and thus, the system may be a hot melt adhesive or other thermoplastic material dispensing system. Referring to FIGS. 2 and 3, the material dispensing system 10 includes, generally, a drive arm 12, a manifold 14, an applicator or nozzle adapter 15, one or more pump assemblies 16, one or more valve module assemblies 18, one or more applicators or nozzles 20 and a filter block 22. In one embodiment, the drive arm 12 includes a drive motor 24, a gear box 26 and an electrical junction box 28. The drive arm 12 may also include one or more power inputs 30. Preferably, the drive arm 12 is movable between first and second positions as described further below.

In one embodiment, the hot melt adhesive or other thermoplastic material dispensing system 10 may be receive the fluid, e.g., the hot melt adhesive or other thermoplastic material, from one or more different supply sources. Accordingly, multiple, different types of fluids may be dispensed from the system 10. In one embodiment, the different types of fluid may be dispensed simultaneously. The fluid or fluids may be applied to the substrate in a desired pattern.

The manifold 14 is preferably a single, one-piece manifold. The manifold 14 includes internal passageways (not shown) facilitating passage of fluid therethrough. In one embodiment, the manifold 14 includes a mounting area 32 configured to have the pump assembly 16 mounted thereon. In one embodiment, the mounting area 32 is disposed on, or recessed from, a top surface 34 of the manifold 14 so that the pump assembly 16 may be substantially or completely top-mounted on the manifold 14. By vertically positioning the pump assembly 16 relative to the manifold 14, a foot print of the material dispensing system 10 may be reduced compared to systems where a pump assembly is rear-mounted to a manifold.

The manifold 14 also includes a pump drive assembly (not shown) comprising a shaft and one or more drive gears (not shown) configured to drive the pump assembly 16. In addition, the manifold includes heating elements (not shown) and wiring cavities for electrical connections (not shown). Thus, in one embodiment, the single manifold 14 may include the pump drive assembly, one or more heating elements, fluid flow conduits and electrical components. By including these features in a single manifold 14, unused spaced may be reduce or minimized relative to known systems where multiple manifolds are incorporated to house different components. Thus, the single manifold 14, according to the embodiments described herein, may be formed having a smaller volume and/or smaller footprint than known multiple-manifold assemblies in existing systems. In one embodiment, the manifold 14 may be formed from aluminum. Forming the manifold 14 from aluminum may provide desired, or improved, heat conductivity and/or transfer characteristics.

The applicator or nozzle adapter 15 is secured to the manifold 14 and is configured to receive fluid pumped from the manifold 14 by the pump assembly 16. The applicator or nozzle adapter 15 includes one or more conduits (not shown) configured to receive the fluid from corresponding conduits in the manifold 14. In on embodiment, the applicator or nozzle adapter 15 may be generally "L" shaped in cross section, but is not limited thereto. The one or more applicators or nozzles 20 may be secured to the applicator or nozzle adapter 15 to receive the fluid therefrom.

In one embodiment, the pump assembly 16 includes a one or more rotary, gear type pump assemblies. Each rotary, gear type pump assembly 16 may be formed as a plurality of plates 36 disposed in sealed, abutting relationship, and/or secured together, similar to the gear pump assemblies shown and described in U.S. Pat. No. 6,688,498 to McGuffey, U.S. Pat. No. 7,908,997 to Lessley et al., and U.S. Pat. No. 8,413,848 to McGuffey, each of which is commonly assigned with the instant application and incorporated herein by reference in their entirety. The pump assemblies 16 of the present embodiments may meter hot melt adhesive or other thermoplastic material delivered to the nozzle 20 by providing the hot melt adhesive or other thermoplastic material to the nozzle 20 at a desired flow rate. The pump assemblies 16 are modular and can be installed and removed from the manifold 14, such that one pump assembly 16 may be replaced with another pump assembly 16 configured to meter the hot melt adhesive or other thermoplastic material at a different flow rate.

Figure 4B:
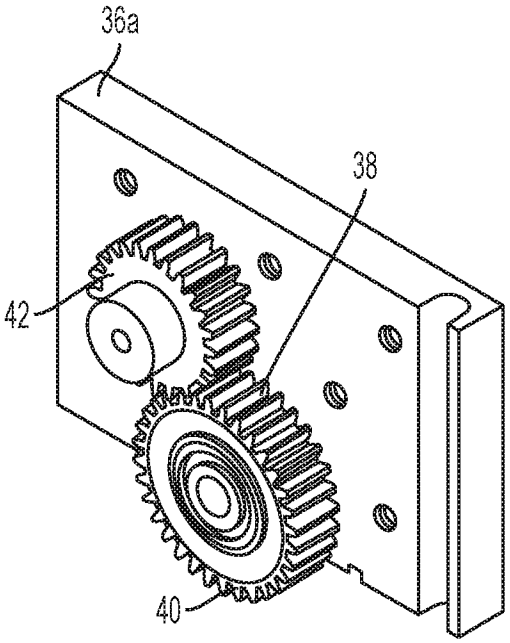
FIG. 4*b* is a perspective view of a portion of the pump assembly of FIG. 4*a* according to an embodiment described herein.
Figure 4A:
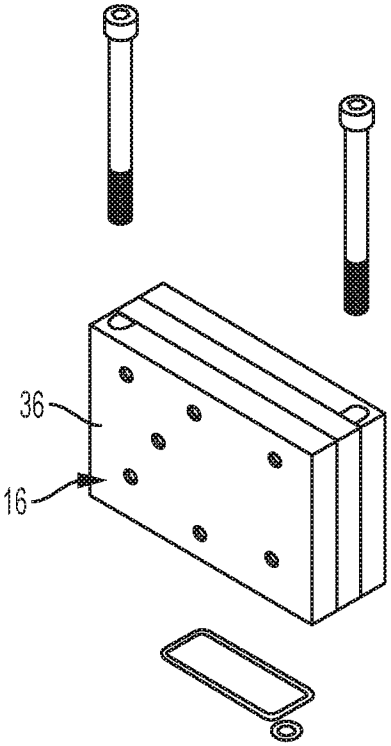
FIG. 4*a* is a perspective view of a pump assembly according to an embodiment described herein.

FIG. 4*a* is a perspective view of a pump assembly 16 comprised of the plurality of plates 36 according to one example described herein, and FIG. 4*b* is a perspective view of one plate 36*a* of the plurality of plates 36 in the pump assembly 16, according to an example described herein. Referring to FIGS. 4*a* and 4*b*, each pump assembly 16 includes a gear train 38. In one embodiment, the gear train 38 includes only two gears 40, 42. In contrast, conventional rotary gear pump assemblies, such as those shown and described in U.S. Pat. No. 6,688,498, are formed with three gears. Accordingly, a size of each pump assembly 16, including its physical volume, height and/or footprint may be reduced in comparison with the three-gear pump assembly in U.S. Pat. No. 6,688,498. It is understood, however, that the present disclosure is not limited to the two-gear configuration described above, and that pump assemblies having two or more gears, for example, a three-gear gear train, may be used in the dispensing system 10 described herein as well. A flow rate provided by an individual pump assembly 16 is predetermined based on a gear ratio of the gear train 38 in the individual pump assembly 16. That is, a flow rate of the hot melt adhesive or other thermoplastic material delivered to the nozzle 20 may be predetermined based on the gear ratio, and can be varied by providing different pump assemblies 16 having different gear ratios. Alternatively, or additionally, flow rate may be varied by controlling power output from the drive motor 24.

As described above, the manifold 14 includes one or more drive gears (not shown). Each drive gear is configured to mesh with one of the gears 40 of the gear train 38 in a pump assembly 16. Thus, the drive gear may be driven to drive the gear train 38 and move the hot melt adhesive or other thermoplastic material through the manifold 14 and pump assembly 16.

Referring again to FIGS. 2 and 3, the drive arm 12 is connected to manifold 14. The drive motor 24 of the drive arm 12 is configured to drive the one or more drive gears (not shown) of the manifold 14 via the gear box 26. In one embodiment, power may be supplied to the drive motor 24 via the power inputs 30 and/or the electrical junction box 28. The drive motor 24 may be selected based on physical size suitable power characteristics. Preferably, a physical size of the drive motor 24 is reduced or minimized relative to known drive motors in existing systems, to reduce the footprint of the system 10. In addition, in one embodiment, the drive motor 24 may be mounted at or near a right angle, i.e., 90 degrees, relative to the shaft of the pump drive assembly.

The filter block 22 is also attached to the manifold 14 and is configured to filter the hot melt adhesive or other thermoplastic material. For example, in one embodiment, the hot melt adhesive or other thermoplastic material may be received into the filter block 22 from a supply source, filtered, and then received in the manifold 14 from the filter block 22. In another configuration, the manifold 14 may be receive the hot melt adhesive or other thermoplastic materials from the supply source, output the adhesive or other thermoplastic material to the filter block 22, and then receive the filtered adhesive or material from the filter block 22.

In one embodiment, the filter block 22 may be constructed without a heating element in order to reduce size of the filter block compared to known filter blocks having a heating element. Accordingly, a footprint of the system 10 may be reduced as well. In the embodiments described herein, a heating element may be omitted from the filter block 22, due, at least in part, to the reduced size of the single manifold 14 relative to known configurations. Because the single manifold 14 is smaller in size than the known multiple-manifold systems, heat from the heating elements in the manifold 14 may be sufficiently distributed in the manifold 14 and/or adjacent components, including the filter block 22, without the need for additional heating elements in the filter block 22 to maintain the fluid at a desired temperature.

Each valve module assembly 18 of the one or more valve module assemblies 18 may include a valve mechanism (not shown). The valve module assembly 18 is configured to selectively control fluid flow from the applicator or nozzle adapter 15 to the applicator or nozzle 20. In one embodiment, the valve mechanism may be a piston.

Each valve module assembly 18 may controlled by a solenoid 44. Each solenoid 44 may include one or more electrical connections 46, one or more air inputs 48 and one or more air outputs 50. The one or more valve assemblies 18 may be substantially the same as those described in the U.S. Pat. No. 8,413,848. In one embodiment, each solenoid 44 is fluidically connected to a respective valve module 18 to control air flow to and from the valve module 18, thereby controlling movement of the valve. In one embodiment, each valve module 18 corresponds to a respective pump assembly 16 of the one or more pump assemblies 16.

In one embodiment, the applicator or nozzle 20 may be a die-shim assembly for use in contact or non-contact applications. It is understood, however, that the applicator or nozzle 20 may be implemented in other forms too. For example, the applicator nozzle 20 may be a non-contact, air assist or non-air assist type nozzle, and/or a nozzle suitable for use in strand coating applications. In one embodiment, the applicator or nozzle 20 is secured to an underside of the nozzle adapter 15 and is configured to receive the hot melt adhesive or other thermoplastic material from the nozzle adapter 15. Further, the applicator or nozzle 20 may be modular and interchangeable with other suitable applicators or nozzles, including the different types of applicators or nozzles described above. In one embodiment, the applicator or nozzle 20 may include a plurality of applicator or nozzles, wherein each applicator or nozzle is fluidically coupled to a corresponding pump assembly 16 and valve assembly 18. Accordingly, discharge of the hot melt adhesive or other thermoplastic material from each applicator or nozzle 20 may be individually controlled by controlling operation of the pump assembly 16 and/or valve assembly 18 associated with each particular applicator or nozzle 20.

Figure 5:
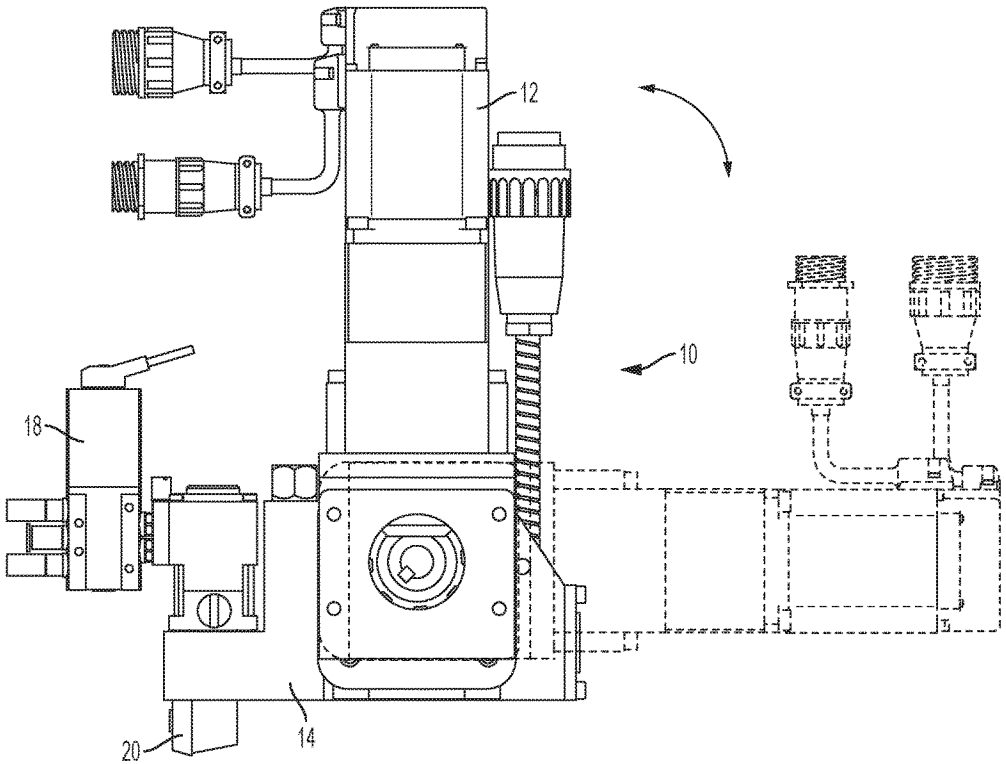
FIG. 5 is a side view of the material dispensing system of FIG. 2.
Figure 6:
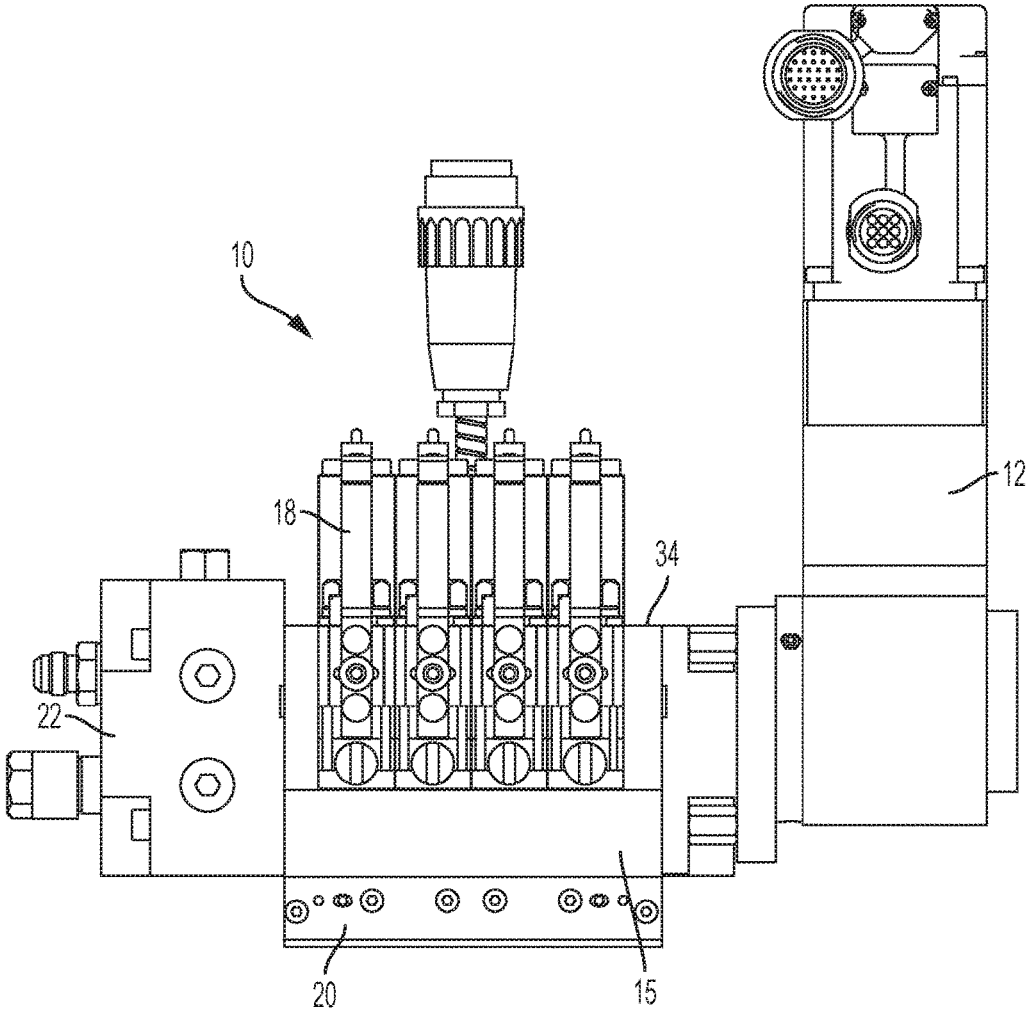
FIG. 6 is a front view of the material dispensing system of FIG. 2.
Figure 7:
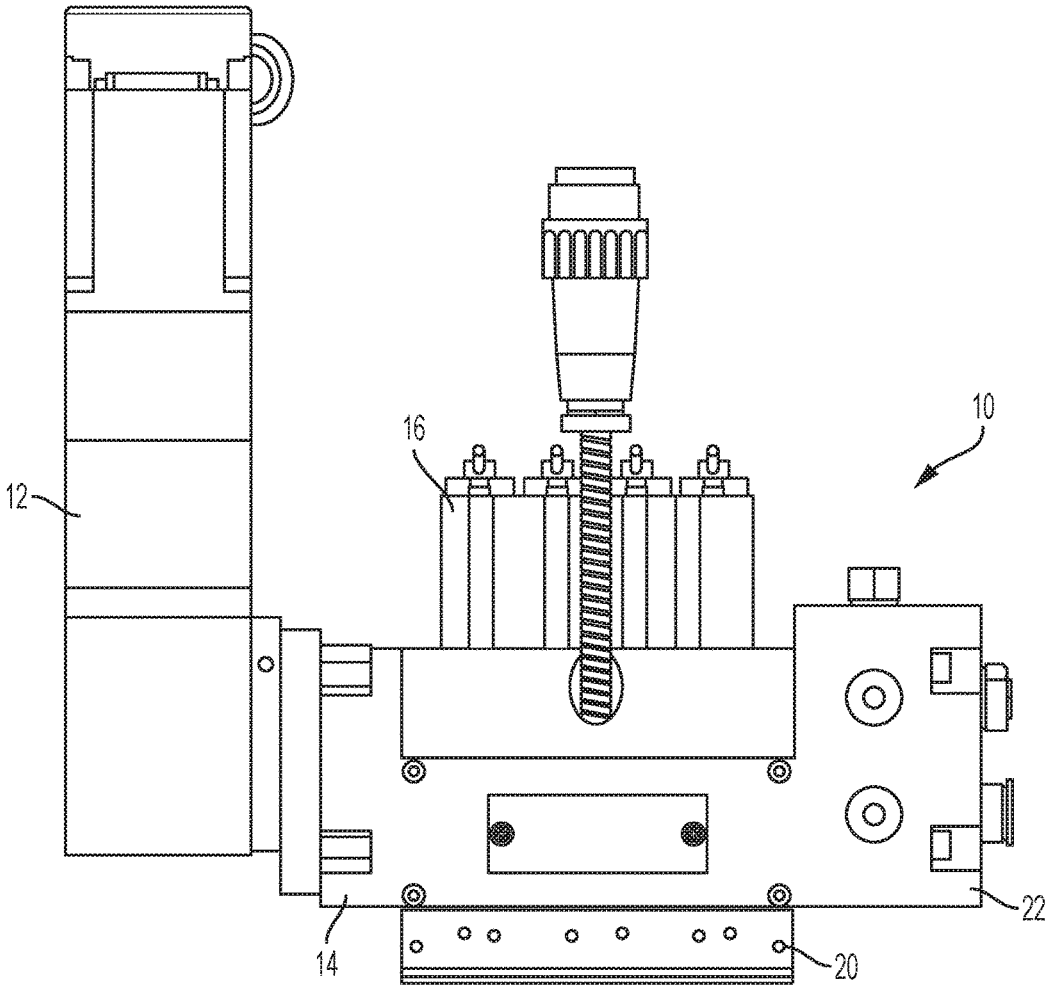
FIG. 7 is a rear view of the material dispensing system of FIG. 2.

FIG. 5 is a side view of the dispensing system 10 of FIG. 2. With reference to FIG. 5, and as shown in dashed lines, the drive arm 12, in one embodiment, is movable between a first position and a second position. For example, the drive arm 12 may be rotated relative to the manifold 14 between a substantially vertical position and a substantially horizontal position, as indicated by the double arrow. Accordingly, the dispensing system 10 described herein may be field configurable, for example, by rotating the drive arm 12 between first and second positions, depending on available space in a manufacturing facility and a desired configuration. With the drive arm 12 in a substantially vertical position, a footprint of the dispensing system 10 may be reduced compared to conventional dispensing systems, such as those shown in U.S. Pat. No. 7,908,997. FIGS. 6 and 7 show front and rear views of the dispensing system 10 of FIG. 2 according to an embodiment described herein, with the drive arm 12 in a substantially vertical position. In another embodiment, the drive 12 may be positioned substantially in-line with the manifold 14, such that the drive arm extends along longitudinal axis extending into the manifold 14.

Figure 8:
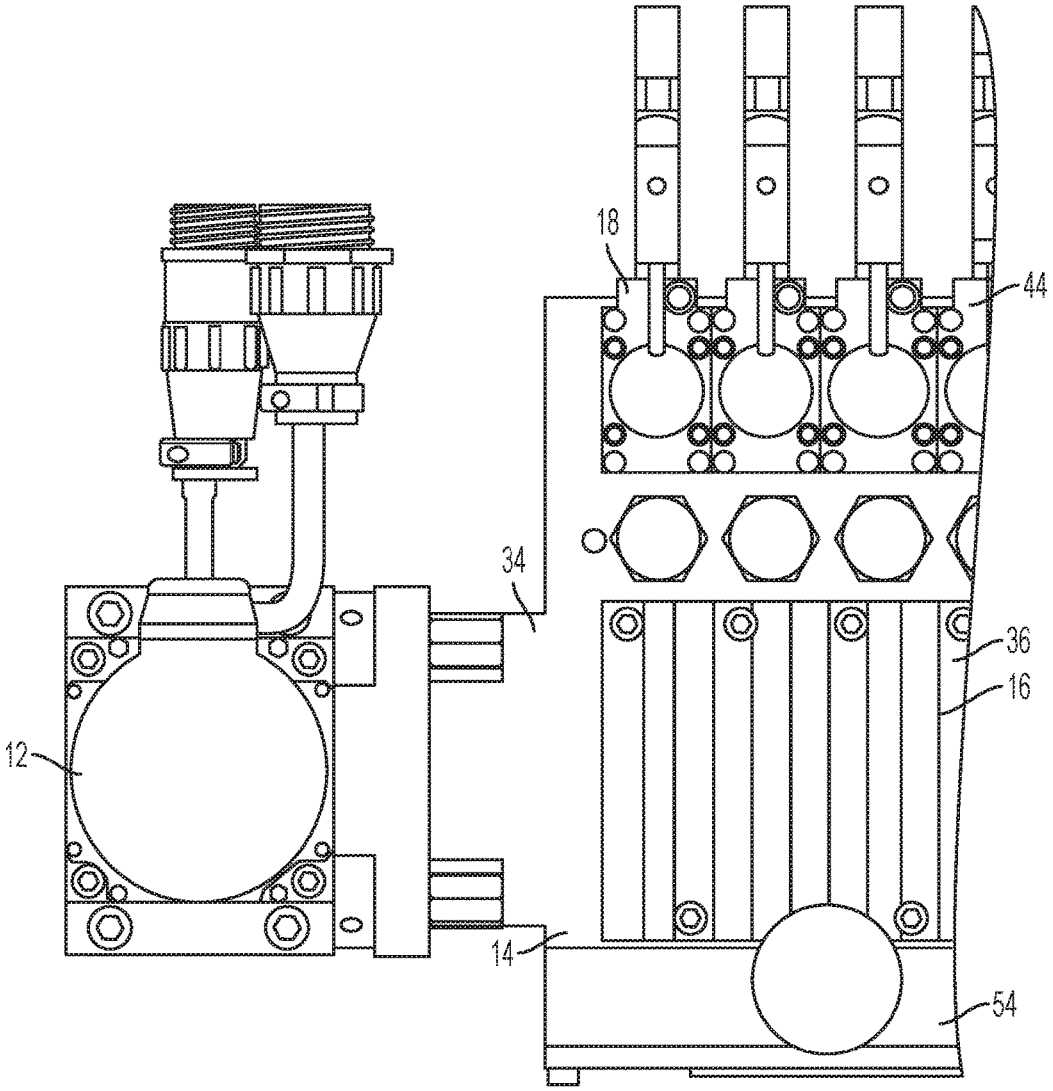
FIG. 8 is a partial top view of the material dispensing system of FIG. 2.

FIG. 8 is a partial, top view of the dispensing system of FIG. 2. Referring to FIG. 8, in one embodiment, the one or more pump assembly 16 does not extend beyond a rear face 54 of the manifold 14. That is, the manifold 14 may underlie and entirety of the one or more pump assemblies 16. Accordingly, as indicated above, by vertically arranging the one or more pump assembly and the manifold, a footprint of the dispensing system 10 may be reduced compared to conventional dispensing systems where pump assemblies are rear-mounted.

In use, the dispensing system 10 described in the embodiments above may be installed or configured in the field, for example, at a manufacturing facility. The drive arm 12 may be positioned as desired, for example, in a substantially vertical position where horizontal space is limited. The hot melt adhesive or other thermoplastic material may be received in the filter block 22 directly or indirectly from a supply source (not shown) through an inlet. The hot melt adhesive or other thermoplastic material may then flow from the filter block 22 into the manifold 14. The drive motor 24 drives the gear(s) within the manifold 14 to drive the one or more pump assemblies 16. Accordingly, the hot melt adhesive or other thermoplastic material may be driven through the manifold 14, into one or more pump assemblies 16 and returned to the manifold 14 at a desired flow rate. The hot melt adhesive or other thermoplastic material may then be delivered to the one or more nozzles 20 via the applicator or nozzle adapter 15 for discharge onto an underlying substrate moving along a longitudinally extending flow path with respect to the dispensing system 10. Flow of the hot melt adhesive or other thermoplastic material may also be controlled by the valve assembly 18.

In the embodiments above, a footprint of the dispensing system 10 may be reduced compared to conventional dispensing systems. The reduced footprint may be realized through a number of features in the embodiments above, including, for example, vertically arranging the one or more pump assemblies 16 on the manifold 14 (i.e., mounting the one or more pump assemblies 16 on a top surface 34 of the manifold 14), using two-gear pump assemblies to reduce the size of the pump assemblies compared to known pump assemblies, using a single manifold 14 to reduce parts and thus, connections between parts, and providing a rotatable drive arm 12 movable between first and second positions. Other considerations may be taken into account as well, such as a physical size of the drive motor.

Additionally, in the embodiments above, the single manifold design may reduce costs. Further, in the embodiments above, higher pump speeds may be realized, due, at least in part, to the dimensions and tolerances of the pump assemblies. Accordingly, an increased pump range relative to conventional three-gear pump assemblies may be realized. Further still, the dispensing system 10 is field convertible to adapt to end-user needs. Metering of the hot melt adhesive or other thermoplastic material may be carried out by the pump assemblies 16 and/or the valve assemblies 18, and thus, may be carried out outside of the manifold 14. This feature allows for a size of the manifold 14 to be reduced compared to conventional manifolds in dispensing systems. With the reduced footprint and size, the dispensing system 10 in the embodiments above may be efficiently used in application to produce smaller products, such as feminine care products. The dispensing system 10 described above is also advantageous in that less space is required for installation and maintenance while retaining all of the benefits and advantages of the conventional dispensing system illustrated in FIG. 1 and disclosed herein.

Many variations and modifications of the disclosed device, system and method are possible in light of the above teachings. It is noted, for example, that while the disclosure has been directed toward the deposition of hot melt adhesive or other thermoplastic materials, the disclosed hybrid dispensing device, system and method can likewise be utilized to dispense other fluids, for example, non-thermoplastic materials.

All patents referred to herein, are hereby incorporated herein in their entirety, by reference, whether or not specifically indicated as such within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

The invention claimed is:

1. A dispensing system for dispensing and depositing one or more fluid depositions onto at least one region of a substrate moving along a longitudinally extending flow path with respect to the dispensing system, comprising:

a manifold having internal passageways for fluid flow therein and one or more drive gears;

a drive arm rotatably mounted on the manifold, the drive arm configured to rotate approximately 90 degrees relative to the manifold between a first position and a second position, the drive arm having a drive motor configured to drive the one or more drive gears;

a pump assembly mounted on a top surface of the manifold, the pump assembly formed as a rotary gear pump having a gear train formed by two gears, wherein one of the gears is disposed in meshed relationship with a respective drive gear of the one or more drive gears;

a filter block for filtering the fluid received in the system;

an applicator adapter fluidically connected to the manifold;

an applicator fluidically connected to the applicator adapter and configured to dispense the fluid onto the substrate; and a valve module assembly configured to control flow of the fluid to the applicator.

2. The system of claim 1, wherein the first position of the drive arm is vertical and the second position of the drive arm is horizontal.

3. The system of claim 1, wherein the drive arm further includes a gear box.

4. The system of claim 1, where in the drive arm further includes a power input.

5. The system of claim 1, wherein the pump assembly comprises a plurality of plates positioned in abutting relationship with one another.

6. The system of claim 1, wherein the gear train of the pump assembly has a predetermined gear ratio to supply the fluid to the manifold and nozzle at a corresponding predetermined flow rate.

7. The system of claim 1, wherein the pump assembly is removably mounted to the manifold.

8. The system of claim 1, wherein the applicator is disposed on an underside of the applicator adapter.

9. The system of claim 1, wherein the applicator includes a die-shim assembly.

10. The system of claim 1, wherein the fluid is a hot melt adhesive.

11. The system of claim 1, wherein the pump assembly is one of a plurality of pump assemblies mounted on a top surface of the manifold, each pump assembly formed as a rotary gear pump having a gear train formed by two gears, wherein one of the gears is disposed in meshed relationship with a respective drive gear of the one or more drive gears.

12. The system of claim 11, wherein the applicator is one of a plurality of applicators fluidically connected to the applicator adaptor and configured to dispense the fluid onto the substrate.

13. The system of claim 12, wherein the valve module assembly is one of a plurality of valve module assemblies configured to control flow of the fluid to respective applicators of the plurality of applicators.

14. The system of claim 1, wherein the gear train of the pump assembly is formed by only two gears.

* * * * *